United States Patent [19]

Jha et al.

[11] Patent Number: 4,775,106

[45] Date of Patent: Oct. 4, 1988

[54] USE OF SMELTER-GRADE SULFURIC ACID AS TRUE HEAVY-LIQUID MEDIA IN COAL CLEANING

[75] Inventors: Mahesh C. Jha, Arvada; Deepak Malhotra, Golden; Frank J. Smit, Arvada, all of Colo.

[73] Assignee: AMAX, Inc., New York, N.Y.

[21] Appl. No.: 101,457

[22] Filed: Sep. 28, 1987

[51] Int. Cl.[4] ..... B02C 23/20

[52] U.S. Cl. ..... 241/20; 209/172.5; 241/21; 241/24

[58] Field of Search ..... 241/20, 21, 24, 16; 209/172.5, 173

[56] References Cited

U.S. PATENT DOCUMENTS 4,132,365 1/1979 Verschuur ..... 241/24 X 4,198,291 4/1980 Yoo et al. ..... 209/172.5

*Primary Examiner*—Howard N. Goldberg

*Assistant Examiner*—Joseph M. Gorski

*Attorney, Agent, or Firm*—Michael A. Ciomek; Eugene J. Kalil

[57] ABSTRACT

A method is provided for removing contaminating minerals from coal by true heavy-liquid media. The coal is comminuted to liberate a substantial portion of the minerals from the coal, the method comprising forming a slurry of the comminuted coal in a solution of smelter-grade sulfuric acid of specific gravity ranging from about 1.2 to 1.7, the specific gravity of the sulfuric acid solution selected being greater than that for the liberated coal but less than that of the contaminating mineral to be separated, thereby effecting substantial separation between the liberated coal and the contained minerals. The coal is removed from the solution and then washed to remove occluded acid therefrom.

5 Claims, 1 Drawing Sheet

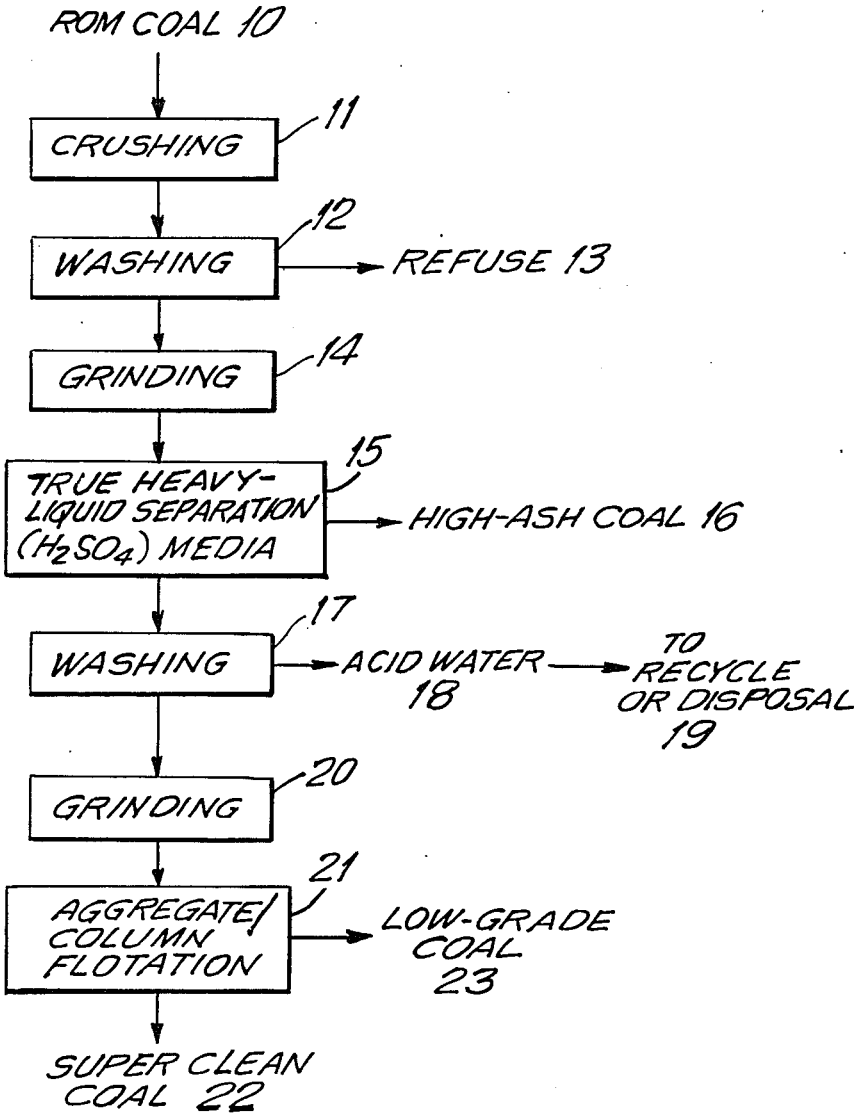
ROM COAL 10
CRUSHING
11
WASHING
12
REFUSE 13
GRINDING
14
TRUE HEAVY-LIQUID SEPARATION ($H_2SO_4$) MEDIA
15
HIGH-ASH COAL 16
WASHING
17
ACID WATER 18
TO RECYCLE OR DISPOSAL 19
GRINDING
20
AGGREGATE/COLUMN FLOTATION
21
LOW-GRADE COAL 23
SUPER CLEAN COAL 22

USE OF SMELTER-GRADE SULFURIC ACID AS TRUE HEAVY-LIQUID MEDIA IN COAL CLEANING

This invention relates to the separation of mineral matter from coal, e.g., ash, pyritic sulfur, etc., and, in particular, to the use of smelter-grade sulfuric acid as true heavy-liquid media for cleaning coal.

STATE OF THE ART

Numerous organizations around the world are involved in research programs relating to the development of cleaning processes for producing low-ash and low-sulfur coals. The purpose is to make coal a more flexible and desirable fuel for use in both conventional applications (for example, pulverized coal for utility boilers) and for new applications, such as coal-water mixtures for utility and industrial boilers, diesel engines and gas turbines. Another purpose is to reduce emissions from all sources of coal utilization.

The production of low-ash and low-sulfur fuels for such applications requires substantially complete liberation of mineral matter from the coal. Thus, the production of clean coal requires two general operations. First, the coal has to be ground to a very fine particle size to liberate the mineral matter. Second, the fine coal particles have to be separated from the fine mineral particles using the differences in their physical properties such as density or hydrophobicity.

As a heterogenous heavy medium, a suspension of magnetite in water has been used to provide specific gravities ranging from about 1.3 to 1.8.

Dense-medium cycloning with minus 325-mesh magnetite slurry media is widely applied to 1-inch×28-mesh coal and, to a certain extent, to coal down to 150 mesh in size. Most efforts have been to make separations at specific gravities between 1.6 and 1.8—in other words, to reject particles containing less than approximately 50 percent coal. A successful operation has been reported at a coal preparation plant in Homer City, Pennsylvania involving the separations of 28—×100-mesh coal at a specific gravity near 1.3. In this operation, locked middling containing between 10 and 50 percent ash is intended to be rejected along with free refuse. There are particle-size limitations on the fineness of coal that can be separated when using a heterogeneous slurry media, and indications are that 100-mesh coal may be near that limit when using 325-mesh magnetite.

True heavy-liquid cycloning becomes attractive for processing very fine coal which would otherwise approach the mesh size of a magnetite media. The use of centrifuges has been suggested for separating fine coal with true heavy-liquids, and predispersion with surfactants and ultrasonic conditioning may be necessary to assure success in the separation of ultra-fine coal.

During the last 10 years or so, several heavy-liquids have been investigated for coal beneficiation purpose. Otisca Industries investigated several halogenated organic liquids such as carbon tetrachloride, Freon-11, and Freon-113 and selected Freon-113 (trichlorofluoromethane) for pilot-scale work. It has been reported that work is being done to develop a gravity separation process for coal using perchloroethylene and trichloroethylene. As for inorganic solutions, sodium chloride and calcium chloride brines have been tested. These liquids, however, have their economic limitations.

Besides the high cost posed by heavy liquids of the organic type, the presence of chlorine or fluorine raises serious environmental problems. Moreover, the use of clean coal in turbine and other applications raises the problem of corrosion due to residual chlorine and fluorine that may be present. In addition, residual organic liquid occluded to the tailings (coal refuse) may classify it as a hazardous waste and necessitate expensive disposal. Because of these two concerns, the recovery and recycle of the organic liquid becomes a necessary part of the process which adds to the overall cost.

According to U.S. Pat. No. 2,623,637, whether a separation is satisfactory or not depends on the requirements for the cleaned products produced by the separation process. If the object is to produce a clean coal having an ash content of about 6%, then it would appear that the separation would have to take place at a specific gravity related to the ash content. Thus, if the faults in the separation system for a certain size range become too high, that is, when too many particles of a specific gravity higher than the specific gravity of separation occur in the cleaned coal fraction, then the ash content of the clean coal fraction will tend to be too high.

Thus, once the requirements for the clean coal, i.e., the highest permissible ash content, are known, the specific gravity of separation can be determined, as well as the maximum permissible fault in the separation.

The aforementioned U.S. patent states that, since the faults in the separation system increase with finer particle size, it becomes necessary to set the specific gravity of separation at a much lower value in order to obtain clean coal of the desired ash content, even though the yield and consequently the efficiency of the process tend to decrease.

To avoid these problems, the potential use of other inexpensive inorganic solutions was explored. However, it was realized that there are not that many solutions which provide the desired specific gravity range (1.2 to 1.7) and which do not add objectionable elements such as chlorine or alkali metals to the coal.

We have discovered an inorganic solution which is economical and which can be used over a specific gravity range of about 1.2 to 1.8.

OBJECTS OF THE INVENTION

It is thus an object of the invention to provide an improved process for cleaning coal using a true heavy-liquid media of the inorganic type.

This and other objects will more clearly appear from the following disclosure, the claims and the appended drawing, wherein the drawing is a flow sheet illustrating one embodiment of the invention.

STATEMENT OF THE INVENTION

We have found that smelter-grade sulfuric acid is an excellent heavy-liquid media for cleaning comminuted coal. Smelter-grade sulfuric acid is economical and sells, according to Chemical Marketing Reporter as of May 25, 1987, for as little as $20 a ton (New Mexico grade) as compared to virgin sulfuric acid which sells for over about $70/ton. Depending on the concentration of the acid, the specific gravity can be varied over a wide range of 1.0 to 1.8.

A 50 percent solution, for example, has a density of about 1.4 grams per milliliter. Viscosity increases with concentration, but in the concentration range of interest (30 to 50 percent), it is only 2 to 5 centipoise. An increase in temperature, generally associated with heat of dilution, should further decrease the viscosity. A 50 percent solution is generally preferred.

Sulfuric acid can be easily washed out with plain water and the solution recycled to the heavy-liquid separation step where make-up acid can be added as concentrated smelter-grade sulfuric acid. A bleed stream of dilute acid can be neutralized with lime and disposed of easily.

One of the biggest advantages of using sulfuric acid is that it is a very widely used commodity with a well established practice for its storage, handling, and disposal in commercial quantities. The only impurity it can impart to coal is sulfate sulfur, the amount of which will be very small if the coal is washed properly. Preliminary laboratory results have demonstrated a significant reduction in mineral matter and total sulfur content of all the coals tested.

Stating it broadly, the invention is directed to a method for removing contaminating minerals from coal which comprises comminuting the coal to liberate substantial amounts of the contaminants, forming a slurry of the comminuted coal in a sulfuric acid solution of specific gravity ranging from about 1.2 to 1.7, the specific gravity selected being greater than that for the liberated coal but less than that of the contaminating mineral.

Raw coal as mined may have a specific gravity in the neighborhood of about 1.5 grams/cm$^3$ due to the presence of contaminating minerals. For example, ash in coal may have a density of about 2.8 grams/cm$^3$; whereas, liberated coal, substantially free of ash may have a density of about 1.2 grams/cm$^3$ to about 1.4 grams/cm$^3$.

Following formation of the slurry, the coal is allowed to separate from the contaminating mineral due to the differences in specific gravity, the heavier mineral sinking in the heavy-liquid compared to the more bouyant liberated coal.

Following the physical separation of coal in the heavy-liquid, the coal is removed and thereafter washed. The coal may be separated using a sink and float process or it may be separated by subjecting the slurry to centrifugal force by means of a cyclone and/or centrifuge. Thus, when referring to coal separation, it is to be understood that the process may be carried out using either the sink and float method or the cyclone or centrifuge method. A typical cyclone method is disclosed in U.S. Pat. No. 2,623,637.

DETAILS OF THE INVENTION

In carrying out the invention into practice, two coals, Illinois No. 6 and Pittsburgh No. 8, were used in the tests. These coals were crushed and screened to produce 28—×100-mesh and minus 100-mesh factions. Sink-float tests were run using sulfuric acid at a separating specific gravity of about 1.4 (50% sulfuric acid concentration) on the coarse fraction. The fine fractions were centrifuged to produce sink and float products. The results are summarized in Table 1. Approximately 70 to 80 percent of the ash and pyrite were rejected from Pittsburgh No. 8 coal in both coarse and fine fractions. Approximately 60 percent of the ash and pyrite were rejected from the fine fraction of Illinois No. 6 coal. These encouraging test results definitely indicate that sulfuric acid is an effective true heavy-liquid media for coal cleaning.

TABLE 1

Preliminary Sink-Float Results Using Sulfuric Acid as True Heavy-Liquid Media (Separation Specific Gravity = 1.4)

| | Illinois No. 6 | | Pittsburgh No. 8 | |
|---|---|---|---|---|
| | 28 × 100 M | −100 M | 28 × 100 M | −100 M |
| Feed, % | | | | |
| Ash | 5.32 | 10.5 | 19.16 | 25.69 |
| Pyritic S | 0.64 | 0.94 | 1.02 | 1.39 |
| Float, % | | | | |
| Weight | 92.4 | 88.5 | 74.9 | 69.7 |
| Ash | 4.42 | 4.75 | 5.35 | 7.29 |
| Pyritic S | 0.55 | 0.40 | 0.40 | 0.34 |

As illustrative of the invention in which smelter-grade sulfuric acid is used as a true heavy-liquid for separating coal from ash and/or pyrite, reference is made to the accompanying flow sheet.

Referring to the flow sheet, run-of-the-mine (ROM) coal 10 is subjected to crushing at 11. The coal is washed at 12 to separate easily removable refuse 13 and the coal then subjected to grinding or comminution at 14 to the appropriate size.

Following grinding, the comminuted coal is slurried at 15 in a bath of smelter-grade sulfuric acid maintained at a specific gravity of about 1.3 to 1.6, the percent by weight of coal in the slurry being about 10 to 25 percent. High ash coal 16 is separated by gravity (i.e., the sink product) and disposed of, while the coal (the float product) is sent to washing at 17. The acid washed off the coal is removed as acid water 18 which, depending upon its concentration and the concentration of the make-up acid, either recycled or disposed of at 19.

The clean coal may then be ground or comminuted at 20 in preparation for further cleaning at 21 using an aggregate/column flotation process to produce super clean coal 22 and low grade coal 23.

The aggregate/column flotation processes are carried out as follows:

A collector is added to the finely-ground coal slurry which aids in the formation of aggregates of particles in the conditioner and or flotation cell. The collector dosage is just sufficient for the formation of loosely held aggregates. These aggregates attach to air bubbles and float. As a result, relatively higher flotation rate of fine coal particles is obtained in comparison to conventional flotation process.

The column flotation process utilizes the principle of counter-current flow to improve separation in the flotation process. In the column flotation, bubbles rise continuously through a downward flowing slurry resulting in washing of liberated mineral particles from the bubbles.

As the process flowsheet shows, heavy-liquid separation can be used in conjunction with the aggregate flotation process to produce super clean coal. Washed Pittsburgh coal was used in tests aimed at determining the advantage of incorporating the true heavy-liquid separation process in the conventional flowsheet and/or aggregate flotation process flowsheet. The results of the tests are presented in Table 2. It will be noted that for the Pittsburgh coal, conventional methods reduced the ash content to only the 4.8 and 5.7 percent levels (Test Nos. 1 and 2), while the aggregate flotation method reduces it to the 2.8 percent level (Test No. 3). When aggregate flotation was applied to coal treated by the sulfuric acid heavy-liquid separation method, the ash content of the clean coal was significantly lowered to 1.61 percent (Test No. 4).

These results indicate that the proposed process is capable of removing the mineral matter and pyritic sulfur in order to produce clean coal.

TABLE 2

Preliminary Flotation Results With/Without $H_2SO_4$ Gravity Separation Process (Pittsburgh No. 8 Coal)

| | | Feed Coal | | Clean Coal | | |
|---|---|---|---|---|---|---|
| Test No. | Method | Ash % | S(Pyritic) % | Weight % | Ash % | S(Pyritic) % |
| 1 | Froth Flotation | 7.5 | 0.61 | 91.9 | 4.8 | 0.56 |
| 2 | Spherical Agglomeration | 7.5 | 0.62 | 98.4 | 5.7 | 0.56 |
| 3 | Aggregate Flotation | 7.4 | 0.74 | 89.1 | 2.8 | 0.38 |
| 4 | Aggregate Flotation Following $H_2SO_4$ Gravity Separation | 5.34* | | 54.0 | 1.61 | 0.30 |

*After $H_2SO_4$ gravity separation.

The aggregate flotation process has been described earlier with regard to spherical agglomeration, if an excess of reagent is added to the slurry, spherical agglomerates will form which are stronger than the aggregates discussed earlier. The spherical agglomerates of clean coal can be separated from the slurry using screens.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In a method for removing contaminating minerals from coal by true heavy-liquid media wherein the coal has been communicated to liberate a substantial portion of said minerals from the coal, the improvement for separating said coal from said minerals which consists essentially of:

forming a slurry of said comminuted coal and minerals in a solution of smelter-grade sulfuric acid of specific gravity ranging from about 1.2 to 1.7.

the specific gravity of the sulfuric acid solution being greater than that for the coal but less than that of the contaminating minerals to be separated, thereby effecting substantial separation between the coal and the minerals, removing the coal from the solution, and then washing said coal thereby removing occluded acid therefrom.

2. The method of claim 1, including maintaining the specific gravity of the sulfuric acid at a range of about 1.3 to 1.6.

3. The method of claim 1, including comminuting the washing coal and then subjecting it to further separation using an aggregate flotation method.

4. In a method for removing contaminating minerals from true heavy-liquid media wherein the coal has been comminuted to liberate a substantial portion of said minerals from the coal, the improvement for separating said coal from said minerals which consists essentially of:

forming a slurry of said comminuted coal and minerals in a solution of smelter-grade sulfuric acid of specific gravity ranging from about 1.2 to 1.7.

the specific gravity of the sulfuric acid solution being greater than that for the coal but less than that of the contaminating minerals to be separated, thereby effecting substantial separation between the coal and the minerals, removing the coal from the solution, then washing said coal thereby removing occluded acid therefrom, then grinding said coal to a size less than about 400 mesh, and then subjecting said coal to aggregate flotation to provide a clean coal containing less than about 1.5% of contaminants.

5. The method of claim 4, including maintaining the specific gravity of the sulfuric acid at a range of about 1.3 to 1.6.

* * * * *